United States Patent [19]

Alexander et al.

[11] 4,414,799

[45] Nov. 15, 1983

[54] ROPE SPLICER

[76] Inventors: Louis Alexander, Rte. 3, Box 924; Willie Brown, Jr., Rte. 1, Box 296, both of St. Martinville, La. 70582

[21] Appl. No.: 367,417

[22] Filed: Apr. 12, 1982

[51] Int. Cl.[3] ..... B65H 69/06

[52] U.S. Cl. ..... 57/22; 57/23; 87/8

[58] Field of Search ..... 57/22, 23, 202; 87/8, 87/33, 34

[56] References Cited

U.S. PATENT DOCUMENTS

| | | | |
|---|---|---|---|
| 1,261,145 | 4/1918 | Maki | 57/23 |
| 1,341,579 | 5/1920 | Olson | 57/23 |
| 1,521,906 | 1/1925 | Rohr | 57/22 |
| 2,384,992 | 9/1945 | Garlinghouse | 57/23 |
| 2,430,980 | 11/1947 | Goodwin | 57/23 |
| 2,491,256 | 12/1949 | Engelke | 57/23 |
| 2,651,824 | 9/1953 | Elsner | 57/202 X |
| 2,702,983 | 3/1955 | Mische | 57/202 |
| 2,712,724 | 7/1955 | Schoonover | 57/23 |
| 3,411,400 | 11/1968 | Morieras et al. | 87/8 |
| 4,036,101 | 7/1977 | Burnett | 87/8 |
| 4,142,353 | 3/1979 | Bruce et al. | 57/22 |
| 4,161,861 | 7/1979 | Storm | 57/22 |

*Primary Examiner*—John Petrakes

*Attorney, Agent, or Firm*—Charles D. Gunter, Jr.

[57] ABSTRACT

A device and method are shown for splicing a rope of the type made up of multiple strands. A frame is adapted to receive a length of rope to be spliced. A flexible cable extending between sides of the frame secures the rope within the frame. A fluid actuated piston-cylinder and cable-pulley arrangement cooperate to provide an upwardly biasing force to bias a selected strand of the rope outwardly from the remaining rope strands secured within the frame. The user of the device can then pass a strand free end through the opening to effect a splice.

3 Claims, 4 Drawing Figures

ROPE SPLICER

BACKGROUND OF THE INVENTION

The present invention relates generally to splicing devices and methods and more particularly to a splicing device for splicing flexible elongate members of the type having multiple strands, such as ropes and cables.

The art of joining or uniting flexible elongated members comprised of multiple strands by weaving together the strand ends is an ancient one. One typical function of a splice in a rope or cable is in forming a loop or eyelet at the end thereof. In such an operation, the splice is customarily made by unwinding the strands at one end of the rope and then weaving and tucking the loosened ends of the strands under four or five successive strands of the main elongate body portion of the rope. Force exerted on the rope body or eyelet merely serves more tightly engage the splice within the body.

In many applications, such as those involving bulky, large diameter ropes or cables, the services of an expert splicer is required and the operation is time consuming and difficult. For instance, the ropes or cables used to moor a ship at a dock might be four inches or more in outer diameter. The bulk of the rope makes it impractical for one person to engage in rope splicing since assistance is required to manipulate the bulky strands while the main rope body is held in place.

There exists a need, therefore, for a splicing device for splicing flexible elongated members made up of a plurality of strands which device is inexpensive to manufacture and simple to operate.

There exists a need for such a device to provide needed leverage in order that both hands of the individual engaged in the rope splicing can be free to manipulate the rope strands.

There further exists a need for such a device which would enable a single worker to effect a splice in a large diameter rope.

SUMMARY OF THE INVENTION

The present splicing device for splicing strands of a rope has a frame adapted to receive a length of rope. A rope retaining means on the frame secures the rope within the frame. A strand separating means on the frame biases at least one strand of the rope outwardly from the remaining rope strands.

Preferably, the frame defines a platform area having at least two support portions arranged at opposite extents of the platform area. A flexible elongate member extends between the two support portions of the frame and is adapted to pass between a selected strand and the remaining strands of the rope for securing the rope within the frame. The flexible elongate member is detachably engaged between the support portions. Power strand separating means selected from the group consisting of hydraulic and pneumatic piston-cylinders are mounted on the platform area on the frame for biasing a selected strand outwardly from the remaining strands of the rope.

The power strand separating means can include a flexible line having a fixed end and having an opposite free end with a coupling means carried thereon for engaging the selected strand of rope. The flexible line is operably associated with the piston-cylinder of the power means whereby actuation of the power means retracts the coupling means to thereby bias the selected strand outwardly from the remaining rope strands received within the frame.

In the method of splicing a rope having a main elongate body with opposite free ends and being made up of multiple strands, a frame is provided for receiving a portion of the main body of the rope proximate a selected free end thereof. Retaining means are provided on the frame for securing the rope portion within the frame and biasing the rope in a first direction with respect to the frame. Strand separating means are provided on the frame for biasing at least one strand of the rope portion secured within the frame outwardly from the remaining rope strands in a direction opposite the first direction. A free end of one of the strands is then passed between the separated strand and remaining strands and the strand separating means is relaxed. The strand separating means is then moved to a next successive strand on the main elongate rope body and the process is repeated to thereby effect a splice.

Additional objects, features, and advantages will be apparent in the written description which follows.

DETAILED DESCRIPTION OF THE INVENTION

Figure 1:
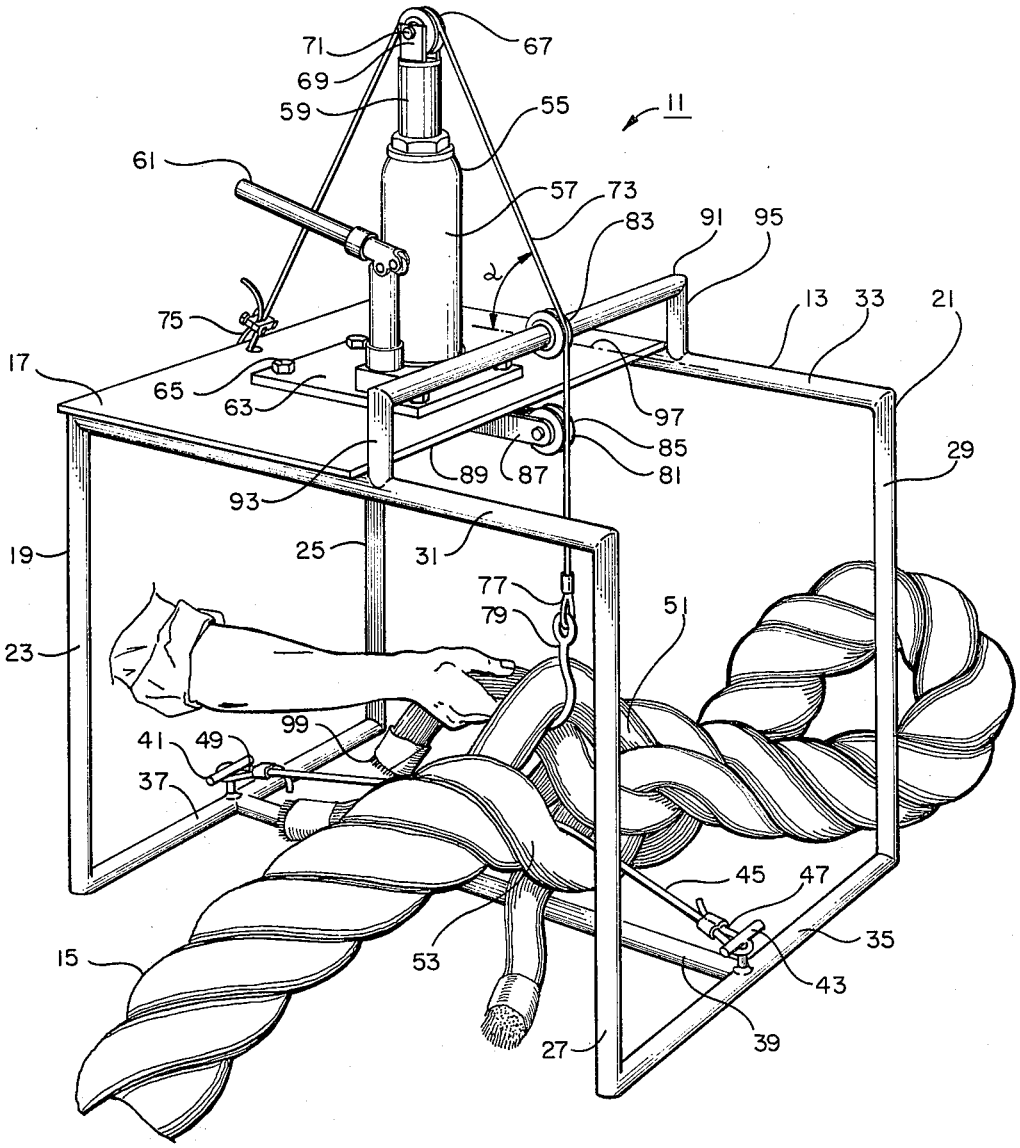
FIG. 1 is a perspective view of the splicing device of the invention showing a rope in place within the frame of the device.

Turning to FIG. 1, there is shown a splicing device of the present invention designated generally as 11. The splicing device 11 includes a frame 13 adapted to receive a length of rope 15. The term "rope" will be used to describe flexible elongate members made up of multiple strands, it being understood that cables, hawsers and the like are also intended to be covered. The frame 13 as shown in FIG. 1 defines a platform area 17 having at least two support portions 19, 21 arranged generally at opposite extents of platform area 17. Support portions 19, 21 can conveniently comprise two identical pairs of spaced-apart parallel bars 23, 25 and 27, 29, respectively. Platform area 17 is supported between the pairs of parallel bars by transverse bars 31, 33 whose ends are joined to the outer extents of parallel bars 23, 25 and 27, 29, respectively.

Another pair of transverse bars 35, 37 connect the outer extents of parallel bars 23, 25 and 27, 29. Parallel bars 23, 25 and transverse bar 37 thus comprise one support portion for platform area 17. In similar fashion, parallel bars 27, 29 and transverse bar 35 comprise a second support portion for platform area 17. Transverse bars 35, 37 are joined at the approximate midpoints thereof by a crossbar 39. A pair of T-shaped projections 41, 43 extend upwardly from transverse bars 35, 37 at the approximate juncture of crossbar 39 with bars 35, 37.

Figure 3:
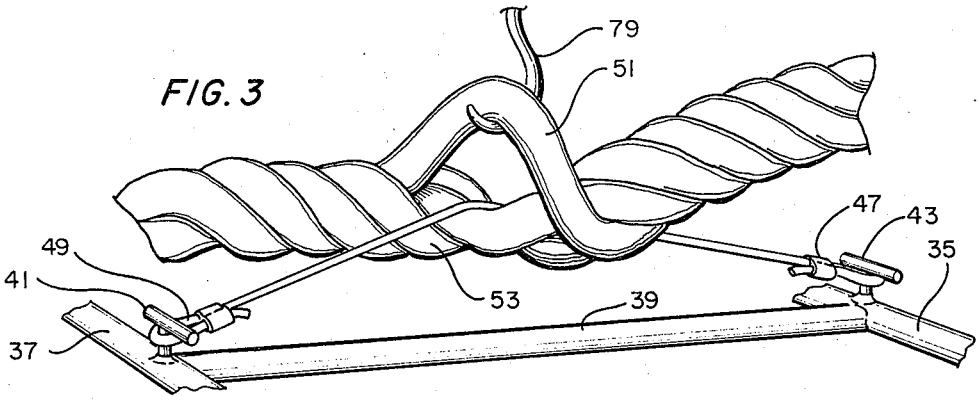
FIG. 3 is a broken away view of the device of FIG. 1 showing the operation of the retaining means and strand separating means on a portion of rope being spliced.

A flexible elongate member such as cable 45 extends between the two support portions 19, 21 of the frame 13. As best seen in FIG. 1, cable 45 has end eyelets 47, 49 formed at the opposite extents for detachably engaging T-shaped projections 41, 43. As shown in FIGS. 1 and 3, cable 45 is adapted to pass between a selected strand 51 and the remaining strands 53 of the main rope body for securing the rope 15 within the frame 13. Cable 45 thus serves as a rope retaining means extending between the two support portions 19, 21 for securing the rope 15 within the frame 13.

As seen in FIG. 1, a strand separating means is provided on the frame 13 for biasing at least one strand of the rope outwardly from the remaining rope strands. The strand separating means can comprise power strand separating means 55 mounted on the platform area 17 on the frame 13 for biasing a selected strand 51 outwardly from the remaining strands 53 of rope 15. The power strand separating means 55 includes a fluid power means selected from the group consisting of hydraulic and pneumatic piston cylinders. The power strand separating means 55 shown in FIG. 1 is a hydraulic jack of the type having a piston cylinder 57 having an outwardly extending piston shaft 59 which shaft is extendable and retractable within cylinder 57 in response to fluid pressure applied by means of jack handle 61. Cylinder 57 is fixed to a base plate 63 and arranged normally thereto. Plate 63 is in turn rigidly secured to platform area 17 by means of a plurality of bolts 65.

The piston shaft 59 of cylinder 57 is fitted with a sheave assembly comprising a grooved wheel 67 rotatably mounted in a yoke 69 by means of a transverse pin 71.

The power strand separating means can further comprise a flexible line 73 having a fixed end 75 and having an opposite free end 77 with a coupling means, in this case hook 79, carried thereon for engaging the selected strand 51 of rope 15.

Guide means such as sheaves 81, 83 on the frame 13 guide and constrain the flexible line 73 during the biasing operation. As shown in FIG. 1, sheave 81 has a grooved wheel 85 and a yoke 87 which is connected to the underside of the leading edge 89 of platform area 17. Sheave 83 is carried on an angle bracket 91 which is mounted between transverse bars 31, 33 by means of depending legs 93, 95. In this way, sheave 83 is positioned above sheave 81 and is free to travel along the length of bracket 91. Sheave 81 being thus positioned creates an angle alpha between the flexible lines 73 and a horizontal axis 97 drawn through the bracket 91 and parallel to the platform area 17.

Flexibled line 73 is thus operably associated with the piston-cylinder 55 of the power means whereby actuation of the power means causes shaft 59 to extend to retract the coupling means 79 to thereby bias the selected strand 51 outwardly from the remaining rope strands 53 secured within the frame 13. As shown in FIG. 1, power piston-cylinder 55 is selectively positioned on the platform 17 intermediate the flexible line fixed end 75 and free end 77 when the free end 77 is coupled to the selected rope strand 51.

Figure 4:
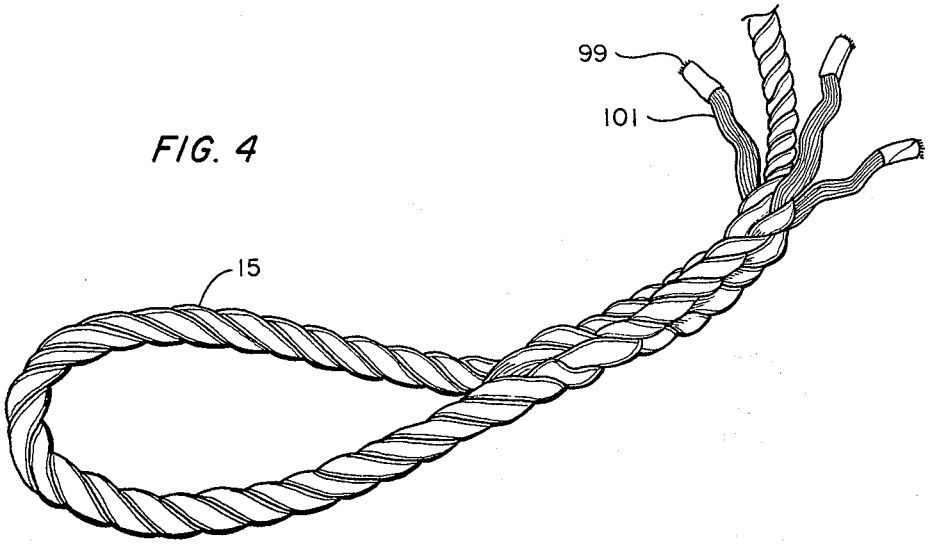
FIG. 4 is a perspective view of a completed splice of a portion of rope made by the present device.
Figure 2:
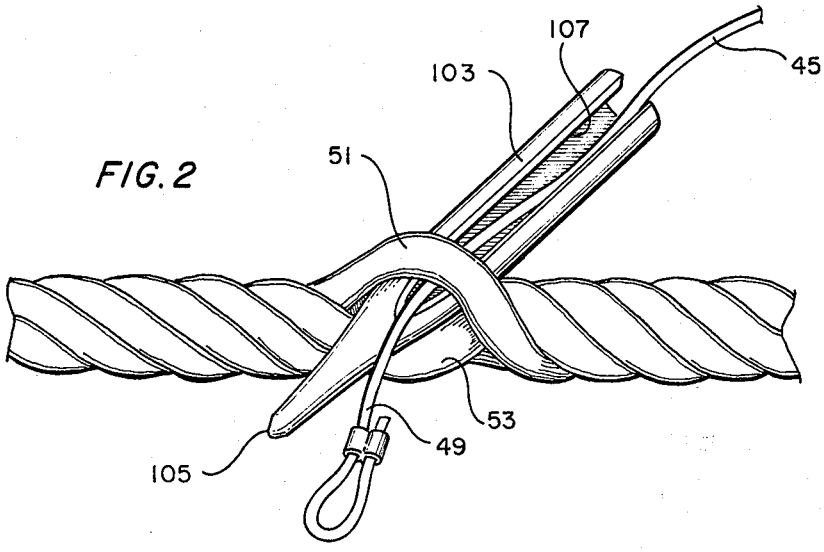
FIG. 2 shows a portion of a rope to be spliced showing the insertion of the retaining means of the device under a selected strand of the rope body.

The method of splicing a rope with the present invention will now be described. FIG. 4 shows a portion of rope 15 of the type having a main elongate body with free ends 99 and being made up of multiple strands 101. In practicing the method of the present invention, a frame 13 is provided for receiving a portion of the main body of the rope 15 proximate a selected free end 99 thereof. The free end 99 of the rope is first passed through the frame, as shown in FIG. 1, so that the portion of the rope to be spliced overlays crossbar 39 within the frame. As shown in FIG. 2, a selected strand 51 of the rope 15 is loosened sufficiently to allow cable 45 to be inserted between the selected strand 51 and the remaining rope strands 53. This can conveniently be accomplished as with a spear like tool 103 having a pointed end 105 for raising the strand and having a cavity 107 in the body thereof for carrying the free end 49 of the cable 45.

The cable 45 is then detachably engaged to the T-shaped projection 41 to secure the rope portion within the frame 13 and to thereby bias the rope 15 in a first direction toward crossbar 39. The hook 79 of the strand separating means is then used to engage the selected strand 51 for biasing the selected strand of the rope portion secured in the frame outwardly from the remaining rope strands 53 in a direction opposite the first direction. The biasing power is provided by actuating the fluid power source 55. Actuation of piston cylinder 57 causes shaft 59 to extend upwardly with respect to platform 17 thereby tensing flexible line 73 and applying a force to strand 51 which is directed oppositely to the restraining force of cable 45.

A free end 99 of one of the strands 101 is then passed between the separated strand 51 and the remaining strands 53. The power strand separating means is then relaxed, the main rope body is moved through the frame a short distance, and the process is repeated with a successive strand to thereby effect a splice. A completed splice is shown in FIG. 4.

An invention has been provided with significant advantages. The splicing device of the present invention provides needed leverage to restrain the main rope body within the frame and simultaneously apply a biasing force to a selected strand so that the workers hands are free to manipulate the rope ends in effecting the splice. The device is simple in construction and easy to operate. Commercially available parts can be used in manufacturing the device.

While the invention has been shown in only one of its forms, it should be understood that it is not thus limited but is susceptible to various changes and modifications without departing from the spirit thereof.

I claim:

1. A process for splicing a large diameter rope having a main elongated body with multiple strands and opposite free ends comprising the steps of:

passing a portion of the main body of said rope proximate a selected free end thereof through a splicing frame, said frame defining a platform area supported by two support portions arranged at opposite extents of said platform area;

providing a flexible elongate member detachably engaged between said two support portions of said frame and a power stand separating means mounted on said platform area;

passing said flexible elongate member between a selected strand and the remaining rope strands of said rope portion and securing said member to said frame to bias said rope portion in a first direction with respect to said frame;

engaging said selected strand with said power strand separating means mounted on said platform and biasing said selected strand in a second opposite direction outwardly from said remaining rope strands to create an opening between said selected strand and said remaining strands;

passing a free end of one of said rope strands between said separated strand and the remaining strands;

relaxing said power strand separating means to thereby secure said free strand within said rope body; and disengaging said flexible elongate member from said frame and moving said rope main body a selected distance through said frame for repeating said process with successive rope strands to effect a splice.

2. A portable, self-contained splicing frame for splicing strands of a large diameter rope, comprising:

a frame defining a platform area having two support portions arranged at opposite extents of said platform area;

a flexible elongate member detachably engaged between said two support portions of said frame and adapted to pass through said rope for securing the rope within the frame to bias said rope in a first direction with respect to said frame;

fluid power strand separating means mounted on said platform area on said frame for biasing said selected strand outwardly from said remaining strands of said rope, said power strand separating means including a fluid piston and a flexible line having a fixed end secured to said frame and an opposite free end with a coupling means carried thereon for engaging said selected strand of rope, said flexible line being operably associated with said piston cylinder of said power separating means whereby actuation of said power separating means retracts said coupling means to thereby bias said selected strand outwardly in a second opposite direction from said remaining rope strands secured within said frame; and guide means on said frame for guiding and constraining said flexible elongate member during said biasing operation.

3. The splicing frame of claim 2, further comprising:

a cross bar passing between said two support portions of said frame, said platform area and two support portions defining a generally square enclosure for receiving said rope when said rope is passed over said cross bar and between said support portions beneath said platform area.

* * * * *